United States Patent [19]

Ketcham et al.

[11] Patent Number: 5,007,316

[45] Date of Patent: Apr. 16, 1991

[54] APPARATUS FOR CUTTING SHEET MATERIALS

[75] Inventors: Stephen O. Ketcham; Paul W. Ortiz, both of Mt. Vernon; Jamie S. Jarvis, Evansville; Clyde S. McCray, Mt. Vernon, all of Ind.

[73] Assignee: General Electric Company, Mt. Vernon, Ind.

[21] Appl. No.: 494,932

[22] Filed: Mar. 14, 1990

Related U.S. Application Data

[63] Continuation of Ser. No. 943,457, Dec. 19, 1986, abandoned.

[51] Int. Cl.[5] ..... B26F 1/14

[52] U.S. Cl. ..... 83/167; 83/685; 83/690

[58] Field of Search ..... 83/681, 684, 685, 686, 83/690, 691, 694, 167

[56] References Cited

U.S. PATENT DOCUMENTS 2,182,744 12/1939 Ehrsam ..... 83/685
3,320,843 5/1967 Schott ..... 83/685
3,996,832 12/1976 Schubert et al. .

FOREIGN PATENT DOCUMENTS 1172495 12/1969 United Kingdom .

*Primary Examiner*—Hien H. Phan
*Assistant Examiner*—Scott A. Smith
*Attorney, Agent, or Firm*—Martin B. Barancik; Joseph T. Eisele

[57] ABSTRACT

A die block component for use in a punch and die assembly is described, having a plurality of grooves in the die face. The block and assembly are useful for cutting articles from sheets and film of synthetic polymeric resins while avoiding the contamination of the article with severed particles and slivers.

9 Claims, 1 Drawing Sheet

APPARATUS FOR CUTTING SHEET MATERIALS

This is a continuation of co-pending application Ser. No. 943,457 filed on Dec. 19, 1986, abandoned.

BACKGROUND OF THE INVENTION

Field of the Invention

The invention relates to apparatus and methods for cutting sheet and film materials and more particularly relates to a punch and die assembly for cutting parts or formed articles from the sheet and/or film.

BRIEF DESCRIPTION OF THE PRIOR ART

Punch and die assemblies are well known tools for cutting shaped articles from webs of sheet materials such as films or sheets of synthetic polymeric resins. The cutting die block may be a stationary plate having an opening therein bordered by a cutting edge suitable for severing the desired article from a sheet of the polymeric resin as it advances intermittently over the die. A reciprocating punch forces the web onto the cutting edge and the severed article through the die opening.

To obtain a clean cut, the clearance between the punch and the cutting edge of the die must meet close dimensional tolerances. This of course adds to the labor and expense of manufacturing the punch and die and of its mounting and assembly in an operating unit. The requirements for maintenance are also increased and operating life shortened due to this demand for close tolerances between the punch and the cutting edge of the die.

Also, even when the closest clearance tolerances are achieved, clean cuts are difficult and sometimes impossible to achieve when certain web materials are to be cut. Synthetic polymeric resins of certain degrees of brittleness may be difficult to cut on a punch and die assembly without creating small particles or slivers that break off the edge of the severed web and/or the cut-out article. This is of course undesirable since the small pieces may pose a health hazard to the operating personnel, represent a waste of material, and may result in a roughened cut edge on the product article. The small pieces may also adhere through static charges to a surface of the cut-out article, thereby contaminating for example a food container article, creating a health hazard to the consumer. Additional production steps may be required to remove the contaminating particles and slivers from the product article.

Although the above-described problems are associated with the punch and die cutting of many forms of sheets and films of synthetic polymeric resin, it is a particular problem with co-extruded, multilayer sheets of diverse polymeric resins.

Co-extruded multi-layer, synthetic polymeric resin films and sheets are well known materials, useful in fabricating thermoformed articles such as food containers, and the like. Their layer components may include a broad variety of polymers, including the different resin layers, adhesives, barrier layers etc. laminated together; see for example the *Encyclopedia of Polymer Science and Technology,* Vol. 2, Chapter 15, Academic Press, Inc. (1978). When cut on a punch and die assembly, there is a greater likelihood of small particles of the multilayers being formed at the face of the sheared cut, even when there are extremely close tolerances between the punch surface and the cutting edge of the die.

The apparatus of the invention comprises a die block, which when used in a punch and die assembly permits the cutting of articles from a sheet or film of a synthetic, polymeric resin, including co-extruded multilayered sheets and film, without forming small cut particles and slivers from the sheared face of the sheet or article which then adhere to the article severed from the sheet, thereby contaminating the desired article. The assembly does not require the extremely close dimensional tolerances between the cutting edge of the die and the punch, required in the prior art assemblies. This yields an advantage of a longer operating life because of the forgiveness of the die even when worn.

SUMMARY OF THE INVENTION

The invention comprises a cutting die block for use in a punch and die assembly, which comprises;

a die plate having a die face surface, a back surface and a peripheral edge defining the boundary of the surfaces of the plate;

said plate having a punch receiving aperture located inwardly of the peripheral edge and communicating between the face surface and the back surface;

said punch receiving aperture being defined by a die cutting edge on the face surface, at the boundary between the face surface and the aperture; and a plurality of grooves in the face surface, extending from the die cutting edge toward the peripheral edge, on an axis transverse to the cutting edge.

The invention also comprises a punch and die assembly which includes as a component, the die block of the invention and the method of its use in severing multilayered sheets or films.

DETAILED DESCRIPTION OF THE PREFERRED EMBODIMENTS OF THE INVENTION

Figure 1:
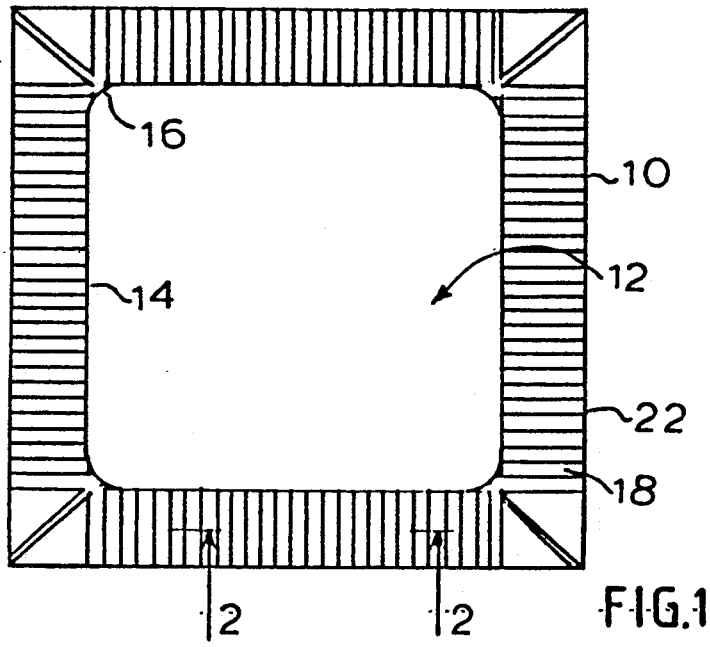
FIG. 1 is a view of the face of the die block of the invention.
Figure 2:
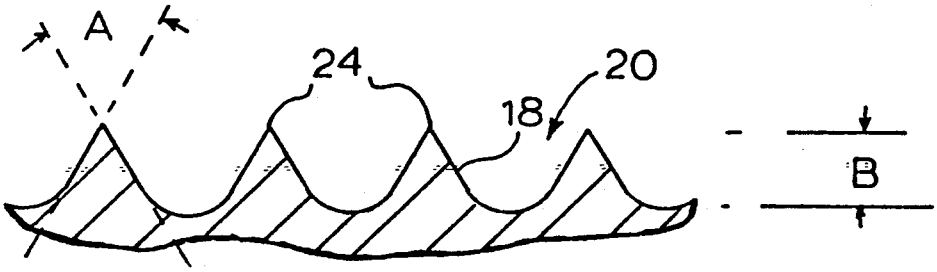
FIG. 2 is a side view, enlarged, along lines 2—2 of FIG. 2.
Figure 3:
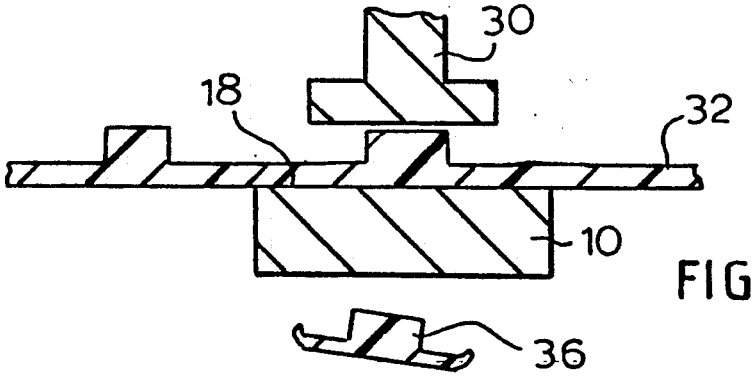
FIG. 3 is a schematic view of a punch and die assembly of the invention having as the die block component, a die block as shown in FIGS. 1 and 2.

Those skilled in the art will gain an appreciation of the invention from a reading of the following description of the preferred embodiments, when read in conjunction with a viewing of the accompanying drawing of FIGS. 1–3, inclusive.

FIG. 1 is a view of the cutting side or die face of a cutting die block 10 of the invention. The block 10, which may be fabricated from any conventional material suited for use as a die block (preferably a machined tool steel) is generally rectangular although any shape may be employed. The block 10 has an aperture 12 for receiving a die punch through the body of the block 10. The aperture 12 is shaped to correspond to the shape of the article to be severed. As shown in FIG. 1, the aperture 12 has arcuate corners 16, although the shape of the corners is not critical to the invention. The face 18 of the die block is bounded by the cutting edge 14 on the perimeter of aperture 12 and the outer, peripheral edge 22 of the die block 10. A back side of the block 10 (not seen in FIG. 1) has essentially the same general appearance as face 18 except that face 18 bears a plurality of grooves 20 extending from the cutting edge 14 toward the peripheral edge 22 in a direction transverse (preferably perpendicular) to the axis of the cutting edge 14. In the embodiment die block 10, the grooves extend to the edge 22 although they need extend only a fraction of a mm. from edge 14, preferably at least 0.5 to 1.0 mm.

FIG. 2 is an enlarged view along lines 2—2 of FIG. 1 and shows in greater detail the open-ended grooves 20 which are substantially straight between cutting edge 14 and peripheral edge 22. The grooves 20 have a depth B below the surface 18. Advantageously, the depth B is not substantially greater or less than the thickness of the sheet or film to be cut, by more than 10 percent of such thickness. As shown in the FIG. 2, the grooves 20 do not have vertical side walls adjacent to peaks 24 (in respect to the horizontal plane of surface 18), but rather the sidewalls of the grooves 20 are angled in respect to the surface 18. The included angle A as shown in FIG. 2 is advantageously within the range of from about 40 to 120 degrees. The greater the angle A, the greater is the tendency for loose particles during cutting, to remain in association with the scrap web or sheet after cutting rather than with the severed article. The number of peaks 24 between grooves 20 for a given distance on surface 18 is of course related to the number of grooves 20 and their width. In general, the greater the number of peaks 24 for a given distance on surface 18, the smoother will be the cut surface of the cut-out article. The width of the peak 24 should therefore be at a minimum as shown in FIG. 2, although some width is acceptable. Advantageously the peak to peak distance is about 0.05 to about 0.18 mm, measured from the centers of the peaks 24. Preferably, the grooves 20 present a cross-sectional configuration wherein the side walls are angled towards the bottom center, adjacent to the peaks 24. As one approaches the bottom of the grooves, the angled side walls are replaced with a concave configuration, centered on the bottom and having an arc radius from the groove 20 centerline. Preferably the arc radius is within the range of from about 0.01 to about 0.1 mm. The grooves 20 have a maximum width at the top within the range of from about 0.05 to about 0.18 mm and a minimum width near the bottom of from 0.001 to 0.01 mm.

FIG. 3 is a schematic view of the die block 10 described above, seen from the side. A reciprocating punch 30 presses against a sheet 32 of synthetic polymeric resin placed on the die block 10 and causes an article 36 to be severed on the cutting edge of the die block 10 and pushed into the open aperture 12. The aperture 12 communicates between the surface 18 and a back surface of the block 10 in the shape of the particular part to be punched. The clearance between the punch 30 and the body of the die block 10 disposed about the periphery of aperture 12 is minimal, and may be within the range of from about 0.0025 to about 0.04 mm. This is a more liberal dimensional tolerance than was required in prior art punch and die assemblies, without excessive particles and slivers being created during operation and which will adhere to the severed article.

The following Example describes the manner and the process of making and using the invention and sets forth the best mode contemplated by the inventors for carrying out the invention but is not to be considered as limiting the invention.

EXAMPLE

A steel punch and die assembly was provided, wherein the die block has a die face as shown in FIGS. 1 and 2 of the accompanying drawings. The grooves in the die face had a peak-to-peak distance of 0.089 mm, an included angle of 90° and a depth of 0.38 mm. The punch had a clearance between itself and the die cutting edge of about 0.00254 mm.

A sheet of multi-layered, polymeric resin was also provided which included a copolyestercarbonate resin inner layer and polyetherimide outer layers. The multi-layered laminate sheet had a thickness of 0.38 mm. After thermoforming of the sheet to mold food tray bottoms, the molded tray bottoms were cut from the continuous sheet, using the punch and die assembly provided. Clean cuts were obtained, with no small particles or slivers remaining in association with the severed tray bottoms. In contrast, when severed with a punch and die assembly differing from the punch and die assembly of the invention by the absence of the grooved die face, small particles and slivers were formed which adhered to the severed article edges.

What is claimed is:

1. A cutting die block for use in a punch and die assembly for cutting from a sheet of synthetic, polymeric resin an article, which comprises;

a die plate having a die surface, a back surface and a peripheral surface which extends perpendicular to said die face surface, said peripheral surface defining an outer boundary of the face and back surfaces of the plate;

said plate having a punch receiving aperture located inwardly of the peripheral surface and communicating between the face surface and the back surface;

said punch receiving aperture being defined by a die cutting edge on the face surface at a boundary between the face surface and the aperture;

a plurality of open grooves in and below the face surface extending across the face surface from the die cutting edge towards the peripheral surface on an axis transverse to the cutting edge; and wherein said article is cut only along the die cutting edge and said open grooves provide a repository for slivers and bits of waste material generated as a result of such cutting.

2. The block of claim 1 wherein the grooves have a depth approximately equal to the thickness of the sheet of material to be cut on the assembly.

3. The block of claim 1 wherein the plurality of grooves each have sidewalls angled in respect to the plane of the face surface, and the angle formed by adjacent side walls of the adjacent grooves is from about 40 to 120 degrees.

4. The block of claim 3 wherein the width at the top of the grooves is from 0.05 to 0.18 mm.

5. A punch and die assembly for cutting of from a sheet of synthetic, polymeric resin an article, which comprises:

a cutting die block for use in a punch and die assembly, which comprises;

a die plate having a face surface, a back surface and a peripheral surface which extends perpendicular to said die face surface, said peripheral surface defining an outer boundary of the face and back surfaces of the plate;

said plate having a punch receiving aperture located inwardly of the peripheral surface and communicating between the face surface and back surface;

said punch receiving aperture being defined by a die cutting edge on the face surface at a boundary between the face surface and the aperture;

a plurality of open grooves in and below the face surface, extending across the face surface from the die cutting edge towards the peripheral surface on an axis transverse to the cutting edge;

a punch adapted by size and configuration to pass into the aperture of the block; and wherein said article is cut only along the die cutting edge and said open grooves provide a repository for slivers and bits of waste material generated as a result of such cutting.

6. A punch and die assembly for cutting from sheet of synthetic, polymeric resin, an article, which comprises;

a cutting die block for use in a punch and die assembly, which comprises;

a die plate having a face surface, a back surface and a peripheral surface which extends perpendicular to said die face surface, said peripheral surface defining an outer boundary of the face and back surfaces of the plate;

said plate having a punch receiving aperture located inwardly of the peripheral surface and communicating between the face surface and the back surface;

said punch receiving aperture being defined by a die cutting edge on the face surface at a boundary between the face surface and the aperture;

collecting means comprising a plurality of open grooves extending from the die cutting edge towards the peripheral surface for collecting slivers and bits of waste material generated as a result of such cutting;

a punch adapted by size and configuration to pass into the aperture of the block; and wherein said particle is cut only along the die cutting edge and said collecting means provides a repository for said slivers and bits of waste material.

7. The assembly of claim 6 wherein the collecting means comprises a plurality of grooves have a depth approximately equal to the thickness of the sheet of material to be cut on the assembly.

8. The assembly of claim 7 wherein the plurality of grooves each have sidewalls angled with respect to the plane of the face surface, and the angle formed by adjacent side walls of adjacent grooves is from about 40 to 120 degrees.

9. The assembly of claim 8 wherein the width at the top of the grooves is from 0.05 to 0.18 mm.

* * * * *

UNITED STATES PATENT AND TRADEMARK OFFICE

CERTIFICATE OF CORRECTION

PATENT NO. : 5,007,316

DATED : April 16, 1991

INVENTOR(S) : Stephen Orin Ketcham, et al

It is certified that error appears in the above-identified patent and that said Letters Patent is hereby corrected as shown below:

Col. 1, line 16, Insert "cutting" after the word "and"

Col. 2, line 39, Delete "2" and add "1"

Col. 3, line 21, Insert "created" before the word "during"

Col. 6, line 20, Delete "7" and add "6"

Signed and Sealed this

Twenty-second Day of September, 1992

*Attest:*

DOUGLAS B. COMER

*Attesting Officer*

*Acting Commissioner of Patents and Trademarks*